US010207414B2

(12) United States Patent
Groeneweg et al.

(10) Patent No.: US 10,207,414 B2
(45) Date of Patent: Feb. 19, 2019

(54) SAFETY KNIFE WITH RETRACTABLE SHEATH

(71) Applicant: Goodrich Corporation, Charlotte, NC (US)

(72) Inventors: Brendan Groeneweg, Brooklyn Park, MN (US); Kruse Otto, Jamestown, ND (US); Wallace H. Larson, Jamestown, ND (US)

(73) Assignee: GOODRICH CORPORATION, Charlotte, NC (US)

( * ) Notice: Subject to any disclaimer, the term of this patent is extended or adjusted under 35 U.S.C. 154(b) by 57 days.

(21) Appl. No.: 15/354,693

(22) Filed: Nov. 17, 2016

(65) Prior Publication Data

US 2018/0133908 A1 May 17, 2018

(51) Int. Cl.
*B26B 5/00* (2006.01)
*B26B 29/02* (2006.01)

(52) U.S. Cl.
CPC ..... *B26B 5/003* (2013.01); *B26B 29/02* (2013.01); *B26B 29/025* (2013.01)

(58) Field of Classification Search
CPC ..... B26B 5/001; B26B 5/003; B26B 29/00; B26B 29/02; B26B 29/025; B26B 27/005; A61B 2017/32113
USPC ..... 30/2, 151, 162, 163, 286; 606/167
See application file for complete search history.

(56) References Cited

U.S. PATENT DOCUMENTS 142,942 A * 8/1873 Ratelle ..... B26B 27/00 30/289
268,997 A * 12/1882 Brion ..... B26B 29/02 30/286
365,714 A * 6/1887 Warner ..... B26B 29/02 30/286
604,624 A * 5/1898 Marble ..... B26B 23/00 30/308.2
923,567 A * 6/1909 Newton ..... B26B 29/025 30/151
1,222,366 A * 4/1917 Curry ..... B26B 29/02 30/286
1,299,084 A * 4/1919 Wilson ..... A22C 21/06 452/120

(Continued)

FOREIGN PATENT DOCUMENTS

EP 1034900 9/2000

OTHER PUBLICATIONS

European Patent Office, European Search Report dated Apr. 18, 2018 in Application No. 17202169.3-1006.

*Primary Examiner* — Jason Daniel Prone
(74) *Attorney, Agent, or Firm* — Snell & Wilmer, L.L.P.

(57) ABSTRACT

A safety knife may include a housing defining an internal cavity, a blade coupled to the housing, and a sheath slideably engaged with the housing. The sheath may translate into the internal cavity of the housing to expose the blade. A switch may be pivotally coupled to the housing and may release the sheath from a locked position in response to depression of the switch. A locking arm may be pivotally coupled to the sheath with a projection that locks the sheath in an extended position by engaging an internal wall of the housing. A pawl may be pivotally coupled to the switch to depress the locking arm. The sheath includes a ridge that engages the pawl and rotates the pawl from a fully extended position.

16 Claims, 7 Drawing Sheets

(56) References Cited

U.S. PATENT DOCUMENTS 1,426,184 A * 8/1922 Hammar ..... B26B 29/02 30/286
1,452,893 A * 4/1923 Porth ..... A22B 5/168 30/286
2,209,751 A * 7/1940 Wulff ..... B26B 5/006 30/2
2,376,887 A * 5/1945 Walters ..... B26B 29/02 30/151
2,730,800 A * 1/1956 Bailey ..... B26B 29/02 30/286
3,781,988 A * 1/1974 Jones ..... B26B 29/02 30/2
4,086,698 A * 5/1978 Sparks ..... B26B 29/02 30/2
4,091,537 A * 5/1978 Stevenson, Jr. ..... B26B 29/02 30/151
4,987,682 A * 1/1991 Minnick ..... B26B 29/02 30/289
5,241,750 A * 9/1993 Chomiak ..... B26B 29/02 30/2
5,250,064 A * 10/1993 Schneider ..... A61B 17/3211 30/151
5,293,791 A * 3/1994 Allen ..... H02G 1/1229 30/90.4
5,330,494 A * 7/1994 van der Westhuizen ..... A61B 17/3211 30/151
5,411,512 A * 5/1995 Abidin ..... A61B 17/3213 30/151
5,478,346 A * 12/1995 Capewell ..... B26B 29/02 30/151
5,522,135 A * 6/1996 Votolato ..... B26B 29/02 30/2
5,581,893 A * 12/1996 Ouellette ..... B26B 29/02 30/286
5,697,157 A * 12/1997 Votolato ..... B26B 29/02 30/2
5,765,289 A * 6/1998 Schulz ..... B26B 29/02 30/292
5,843,107 A * 12/1998 Landis ..... A61B 17/3211 606/167
5,852,874 A * 12/1998 Walker ..... B26B 29/02 30/2
5,890,290 A * 4/1999 Davis ..... B26B 29/02 30/2
6,070,326 A * 6/2000 Berns ..... B26B 29/02 30/2
6,178,640 B1 * 1/2001 Votolato ..... B26B 29/02 30/2
6,233,832 B1 * 5/2001 Berns ..... B26B 29/02 30/162
6,560,873 B1 * 5/2003 Ortner ..... B26B 29/02 30/2
6,578,266 B2 * 6/2003 Chomiak ..... B26B 27/005 30/2
6,748,659 B1 * 6/2004 Street ..... B26B 29/02 30/2
7,082,688 B2 * 8/2006 Votolato ..... B26B 29/02 30/2
7,322,110 B2 * 1/2008 Hernandez ..... B26B 5/001 30/162
7,346,989 B2 * 3/2008 Shi ..... A61B 17/3213 30/151
7,356,928 B2 * 4/2008 Votolato ..... B26B 29/02 30/2
7,475,480 B2 * 1/2009 Votolato ..... B26B 29/02 30/2
7,485,126 B2 * 2/2009 Adelman ..... B26B 29/02 30/286
7,509,742 B2 * 3/2009 Votolato ..... B26B 29/02 30/151
7,726,029 B2 * 6/2010 Votolato ..... B26B 29/02 30/151
7,774,942 B2 * 8/2010 Schmidt ..... B26B 29/02 30/286
7,810,241 B2 * 10/2010 Pooler ..... A61B 17/3211 30/151
7,886,443 B2 * 2/2011 Votolato ..... B26B 29/02 30/151
RE42,507 E * 6/2011 Wilkinson ..... B26B 29/025 30/151
7,966,732 B2 * 6/2011 Votolato ..... B26B 29/02 30/151
8,046,922 B2 * 11/2011 Eby ..... B26B 29/02 30/151
8,099,868 B1 * 1/2012 Votolato ..... B26B 29/02 30/2
8,114,103 B2 * 2/2012 Rasco ..... A61B 17/3213 30/151
8,117,754 B2 * 2/2012 Lion ..... B26B 29/02 30/286
8,127,452 B2 * 3/2012 Garavaglia ..... B26B 29/02 30/151
8,136,251 B2 * 3/2012 Endo ..... A61B 17/3211 606/167
8,209,870 B2 * 7/2012 Votolato ..... B26B 29/02 30/151
8,234,790 B2 * 8/2012 Schmidt ..... B26B 29/02 30/151
8,256,331 B2 * 9/2012 Auchter ..... A61B 17/3211 30/151
8,347,509 B2 * 1/2013 Votolato ..... B26B 29/02 30/151
8,720,068 B2 * 5/2014 Landwehr ..... B26B 29/02 30/162
8,732,956 B2 * 5/2014 McGushion ..... B26B 29/02 30/151
8,764,781 B2 * 7/2014 Auchter ..... A61B 17/3211 30/151
8,875,405 B2 * 11/2014 Trees ..... A61B 17/3211 30/151
8,904,649 B2 * 12/2014 Garavaglia ..... B26B 29/02 30/125
8,938,883 B2 * 1/2015 Gringer ..... B26B 5/001 30/155
8,955,226 B2 * 2/2015 Schmidt ..... B26B 29/02 30/151
8,959,778 B2 * 2/2015 Baid ..... A61B 17/3213 30/151
9,003,668 B2 * 4/2015 Landwehr ..... B26B 29/02 30/286
9,492,931 B2 * 11/2016 Schmidt ..... B26B 29/02
9,676,107 B2 * 6/2017 Garavaglia ..... B26B 29/02
9,681,886 B2 * 6/2017 Jesseph ..... A61B 17/3211
9,757,146 B2 * 9/2017 Vodinh ..... B26B 29/02
9,827,686 B2 * 11/2017 Raymond ..... B26B 29/02
2002/0124412 A1 * 9/2002 Votolato ..... B26B 29/02 30/200
2002/0124418 A1 * 9/2002 Votolato ..... B26B 29/02 30/294
2003/0074013 A1 * 4/2003 Schooler ..... A61B 17/3213 606/167
2003/0229988 A1 12/2003 Jennings
2007/0078472 A1 * 4/2007 Singh ..... A61B 17/3211 606/167
2008/0163493 A1 * 7/2008 Votolato ..... B26B 5/003 30/154
2009/0131963 A1 * 5/2009 Rasco ..... A61B 17/3213 606/172
2009/0151168 A1 6/2009 Dadam
2009/0271988 A1 * 11/2009 Votolato ..... B26B 5/003 30/158
2009/0313836 A1 * 12/2009 Wei ..... B26B 29/02 30/286
2016/0229074 A1 * 8/2016 Rohrbach ..... B26B 29/02
2017/0120462 A1 * 5/2017 Votolato ..... B26B 29/02

(56) References Cited

U.S. PATENT DOCUMENTS

| | | | | |
|---|---|---|---|---|
| 2017/0120469 | A1* | 5/2017 | Votolato | B26B 29/025 |
| 2017/0291317 | A1* | 10/2017 | Votolato | B26B 29/02 |
| 2018/0001489 | A1* | 1/2018 | Scimone | B26B 29/025 |

* cited by examiner

SAFETY KNIFE WITH RETRACTABLE SHEATH

FIELD

The disclosure relates generally to a safety knife having a retractable sheath.

BACKGROUND

Knives and razor blades may be used to cut and manipulate work pieces. Knives occasionally cause laceration injuries due to slips, misuse, or other accidental operation. Typical utility knives are often sharp and slight mishaps can result in deep cuts. Some companies may even mandate that employees use safety knives for cutting and trimming operations on work pieces such as tape, sealants, or boxes, for example.

SUMMARY

A safety knife having a retractable sheath is provided. The knife includes a housing with an internal cavity. A blade is coupled to the housing. A sheath covers the blade and translates into the housing to expose the blade.

In various embodiments, a switch may be coupled to the housing to release the sheath from a locked position in response to depression of the switch. A locking arm may be pivotally coupled to the sheath with a projection of the arm configured to lock the sheath in an extended position by engaging an internal wall of the housing. A pawl may be pivotally coupled to the switch. The pawl may also depress the locking arm in response to the depression of the switch relative to the housing. A recess may be formed in the sheath to expose a portion of the locking arm to the pawl in response to the pawl being in a fully extended position. A torsion spring may be coupled to the pawl to urge the pawl into the fully extended position.

In various embodiments, the sheath may have a ridge that rotates the pawl from the fully extended position. The ridge may also allow the pawl to rotate into the fully extended position in response to the sheath extending into a safe state. A spring may lock the sheath into the locked position by positioning the projection to engage the internal wall of the housing.

In various embodiments, the knife may have a first anchor point coupled to the sheath, a second anchor point coupled to the housing, and a spring extending between the first anchor point and the second anchor point. A blade retention system may removably couple the blade to the housing. The blade retention system may include a nut retained in the housing, and a fastener extending through an opening in the blade and into the nut. The nut may also have an elongated cross section that aligns with a slot formed in the sheath.

A safety knife is also provided and includes a housing defining an internal cavity, a blade coupled to the housing, and a sheath slideably engaged with the housing. The sheath may translate into the internal cavity of the housing to expose the blade. A switch may be pivotally coupled to the housing and may release the sheath from a locked position in response to depression of the switch.

In various embodiments, a locking arm may be pivotally coupled to the sheath. The locking arm may have a projection that locks the sheath in an extended position by engaging an internal wall of the housing. A pawl may be pivotally coupled to the switch to depress the locking arm. The sheath includes a ridge that engages the pawl and rotates the pawl from a fully extended position.

A safety knife according to various embodiments includes a housing comprising a first anchor point. A blade is coupled to the housing with a sheath slideably engaging the housing to expose the blade. The sheath may have a second anchor point with a spring coupled to the first anchor point and the second anchor point.

In various embodiments, the spring urges the sheath into a safe state with the blade covered by the sheath. A switch may be coupled to the housing to release the sheath from a locked position in response to depression of the switch.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosures, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration and their best mode. While these exemplary embodiments are described in sufficient detail to enable those skilled in the art to practice the disclosures, it should be understood that other embodiments may be realized and that logical, chemical, and mechanical changes may be made without departing from the spirit and scope of the disclosures. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

The safety knife of the present disclosure is, in various embodiments, an exposure-control knife with a blade-sheath lock. The blade sheath is also retractable, and has an auto-locking mechanism. The sheath may cover the blade in response to the blade not being in contact with a surface for a cutting operation. The sheath may automatically cover the blade in response to the blade being removed from a cutting surface. The sheath may automatically cover the blade even if the sheaths switch feature is in the activated and unlocked position.

Figure 1:
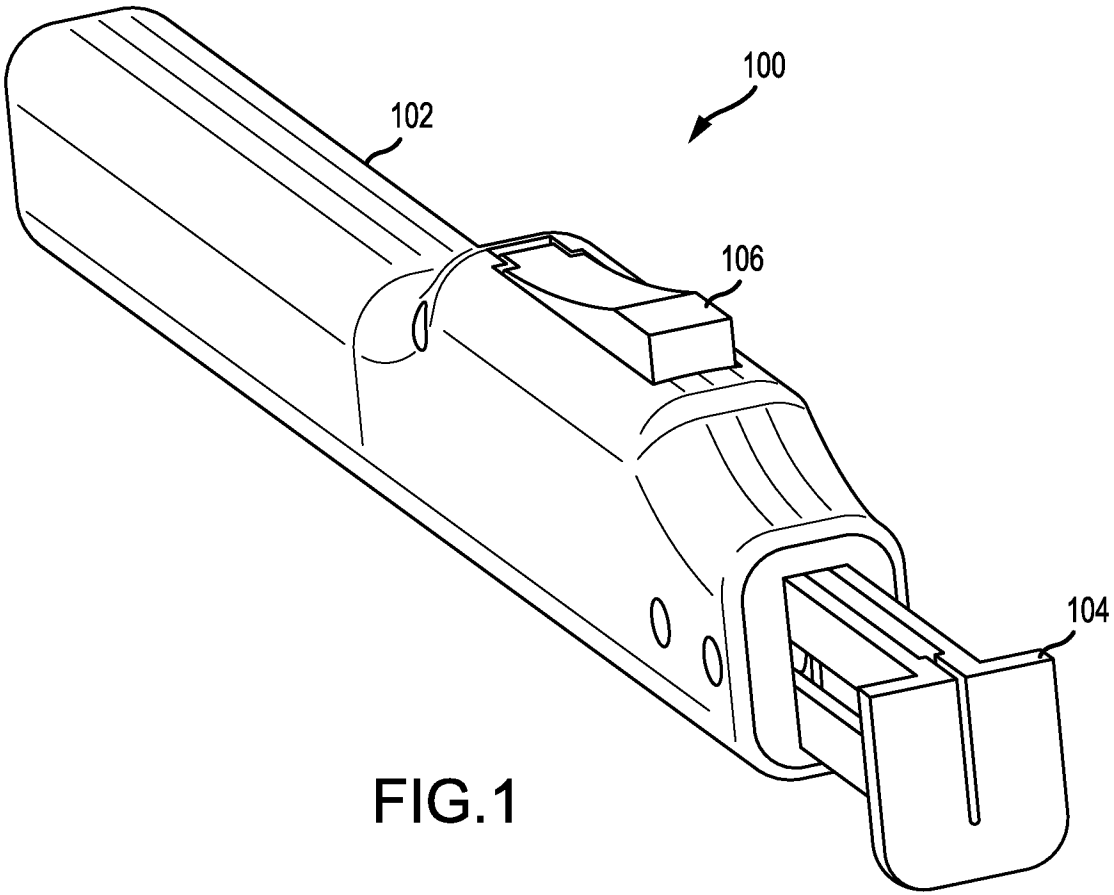
FIG. 1 illustrates a perspective view of a safety knife with a safety sheath covering the blade, in accordance with various embodiments.

Referring now to FIG. 1, a perspective view of safety knife 100 is shown, in accordance with various embodiments. Safety knife 100 may include a housing 102 that serves as a handle to safety knife 100. Housing 102 may be made from suitable materials including metals, plastics, thermoplastics, composites, or molded resins, for example. A sheath 104 may slide into and out housing 102 to expose a blade and cover a blade, respectively. A switch 106 may be depressed into housing 102 to release the sheath 104 from a locked position.

Figure 2:
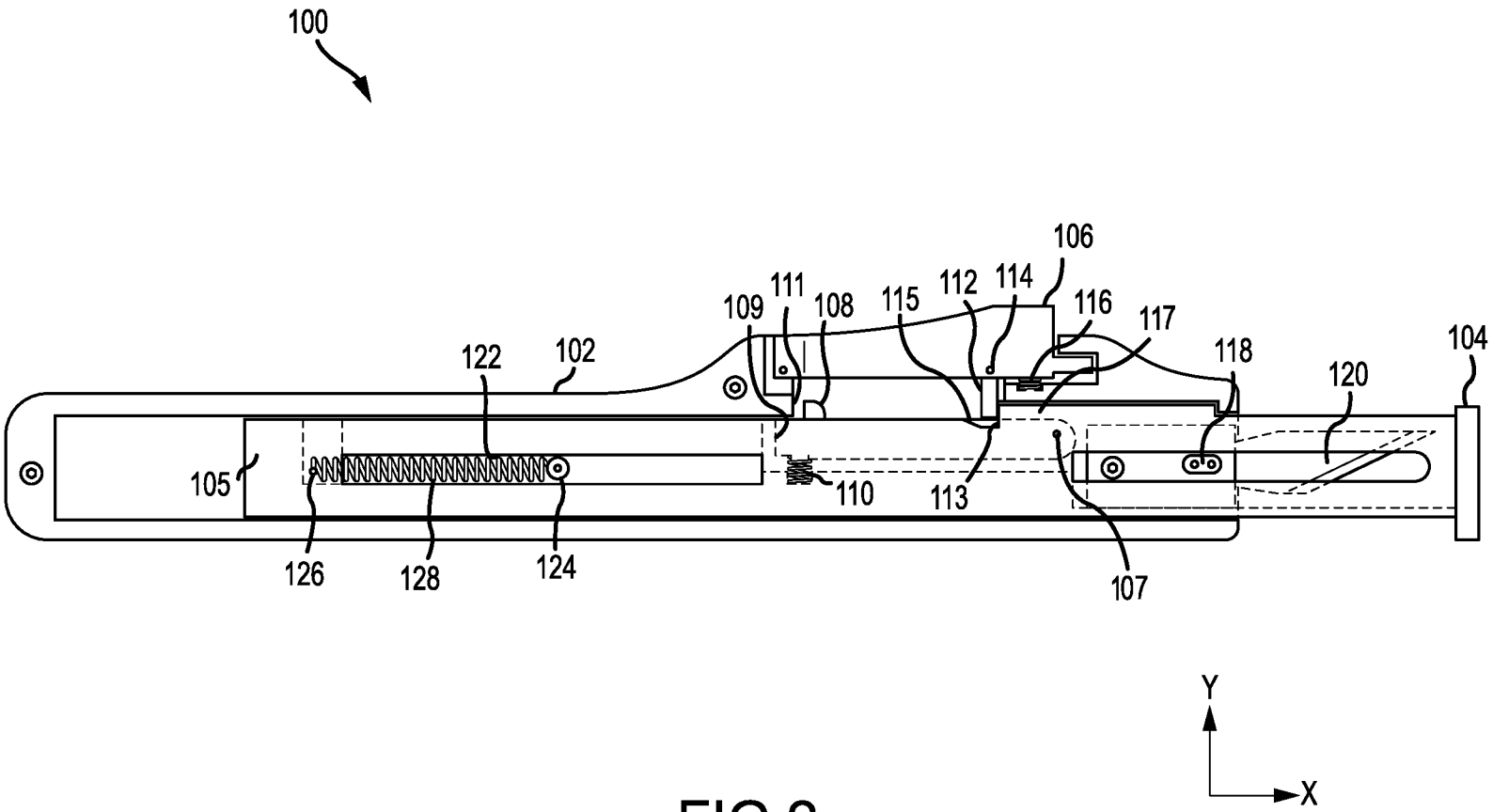
FIG. 2 illustrates a partial cross-sectional view of a safety knife with a safety sheath covering the blade, in accordance with various embodiments.

Referring now to FIG. 2, a cross-sectional view of safety knife 100 is shown with sheath 104 fully extended from housing 102 and locked into position, in accordance with various embodiments. Sheath 104 may include slot 122 formed in internal portion 105. Slot 122 may extend along sheath 104 in the x direction, which is also the direction of travel of sheath 104 relative to housing 102. Sheath 104 may include anchor point 126 that anchors one end of a spring 128. In that regard, anchor point 126 may be fixed relative to sheath 104. Spring 128 may also be coupled to anchor point 124, which is fixed relative to housing 102. Thus, spring 128 may extend in response to sheath 104 translating in the x direction into housing 102. Spring 128 may thus apply a force tending to urge sheath 104 into a position extending out housing 102 in the x direction. Spring 128 biases safety knife 100 into a safe state with the blade 120 covered by the sheath 104.

In various embodiments, safety knife 100 may include various safety features. Switch 106 may be biased in the y direction into the undepressed position by spring 116. A pawl 112 may be pivotally coupled to switch 106 by joint 114. Pawl 112 may be aligned in the y direction (vertically) with depression 115 in sheath 104. Sheath 104 may retain a locking arm 109 (represented by broken lines) pivotally coupled to sheath 104 at joint 107. A portion of locking arm 109 may be exposed from sheath 104 by depression 115 in sheath 104. The exposed portion of locking arm 109 may align with pawl 112. Pawl 112 is configured to depress the exposed portion of locking arm 109 in response to depression of switch 106. As described in greater detail in FIG. 5 below, pawl 112 may be completely extended to effectively depress locking arm 109.

In various embodiments, locking arm 109 may pivot about joint 107 in response to depression by pawl 112. Projection 108 of locking arm 109 may move downward (in the y direction) to provide clearance in the x direction between projection 108 and wall 111 of housing 102. Sheath 104 may be allowed to retract into housing 102 in the x direction in response to projection 108 clearing wall 111. In response to sheath 104 retracting into housing 102 in the x direction, wall 113 of sheath 104 may contact pawl 112 and rotate pawl 112 about joint 114. Wall 113 of sheath 104 may be adjacent depression 115 in sheath 104. Wall 113 may define an internal edge of ridge 117 of sheath 104. Thus, ridge 117 may maintain pawl 112 in a rotated state in response to sheath 104 sliding into housing 102.

In various embodiments, locking arm 109 may also compress spring 110 in response to depression by pawl 112. In that regard, spring 110 is configured to lock sheath 104 into place by urging locking arm 109 to rotate about joint 107 and raise projection 108 in the y direction (vertically) to overlap with wall 111 in the x direction (horizontally). A blade retention system 118 may retain blade 120 in safety knife 100.

Figure 3:
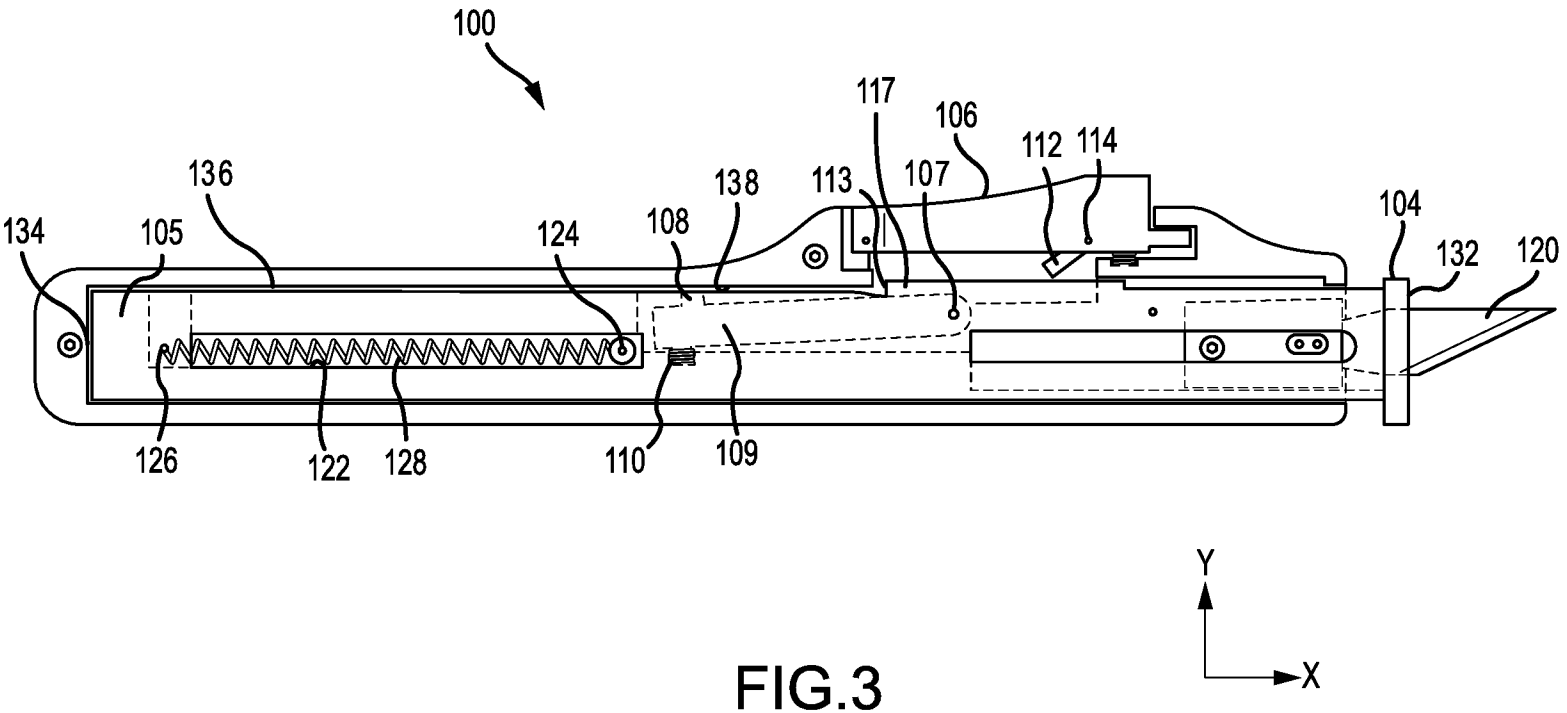
FIG. 3 illustrates a partial cross-sectional view of a safety knife with a blade exposed from a safety sheath, in accordance with various embodiments.

Referring now to FIG. 3, a cross-sectional view of safety knife 100 is shown with sheath 104 retracted into housing 102 to expose blade 120, in accordance with various embodiments. A force may be applied at surface 132 to drive sheath 104 into housing 102 in the x direction. The applied force may be a reactive force applied by a cutting surface in response to sheath 104 of safety knife being pressed towards a cutting surface. Sheath may translate linearly towards end 134 of internal cavity 136 defined by housing 102. Spring 128 may be stretched between anchor point 126 and anchor point 124 in response to the translation of sheath 104.

In various embodiments, locking arm 109 may be maintained in a pivoted position, compressing spring 110, by projection 108 slidably engaging surface 138 of internal cavity 136. Sheath 104 may have a limited range of retraction based on at least one of the depth of end 134 in the x direction relative to internal portion 105, the location of anchor point 124 relative to slot 122 in the x direction, or the location of wall 113 relative to housing 102 in the x direction, for example. Switch 106 is depicted as released and in an undepressed position in FIG. 3. Pawl 112 remains rotated about joint 114 in response to contact with ridge 117 of sheath 104.

Figure 4:
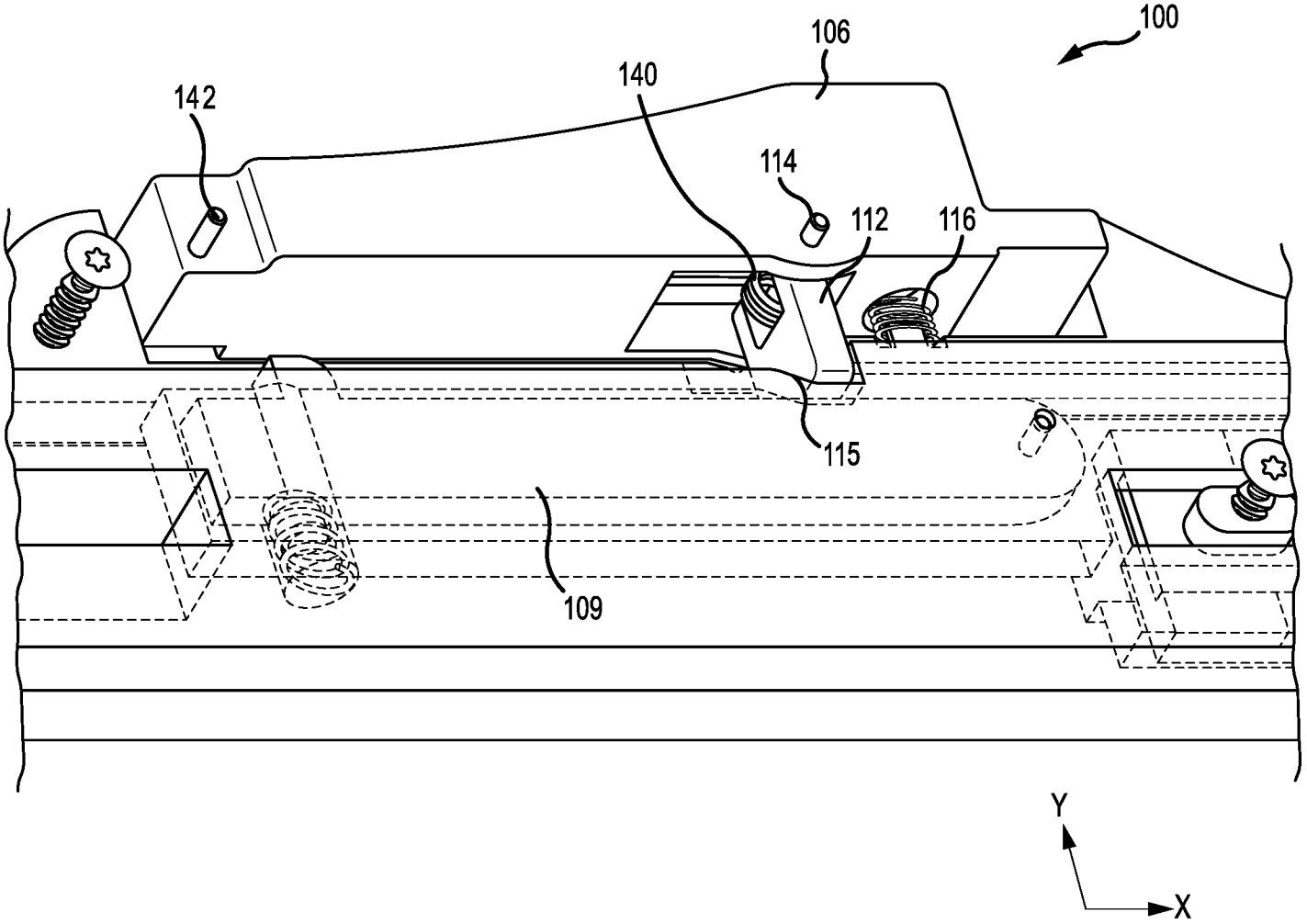
FIG. 4 illustrates a perspective view of a switch assembly for a safety knife with the outer housing of the safety knife partially removed, in accordance with various embodiments.

Referring now to FIG. 4, switch 106 of safety knife 100 is shown, in accordance with various embodiments. Switch 106 may operate by pivoting about joint 142 in response to a pressing force applied in the y direction. For example, a user may depress switch 106 with their thumb, thereby causing switch 106 to rotate about joint 142 and compress spring 116. Spring 116 may urge switch 106 into the undepressed position in response to the pressing force being removed from switch 106.

In various embodiments, pawl 112 may be rotatably coupled to switch 106 by joint 114. Pawl 112 may include a torsion spring 140 configured to bias pawl 112 into the extended position as illustrated in FIG. 2. Thus, torsion spring 140 tends to urge pawl 112 from the pivoted position (of FIG. 3) into the extended position (of FIG. 2). In the fully extended position, pawl 112 may align with depression 115 to engage locking arm 109.

Figure 5:
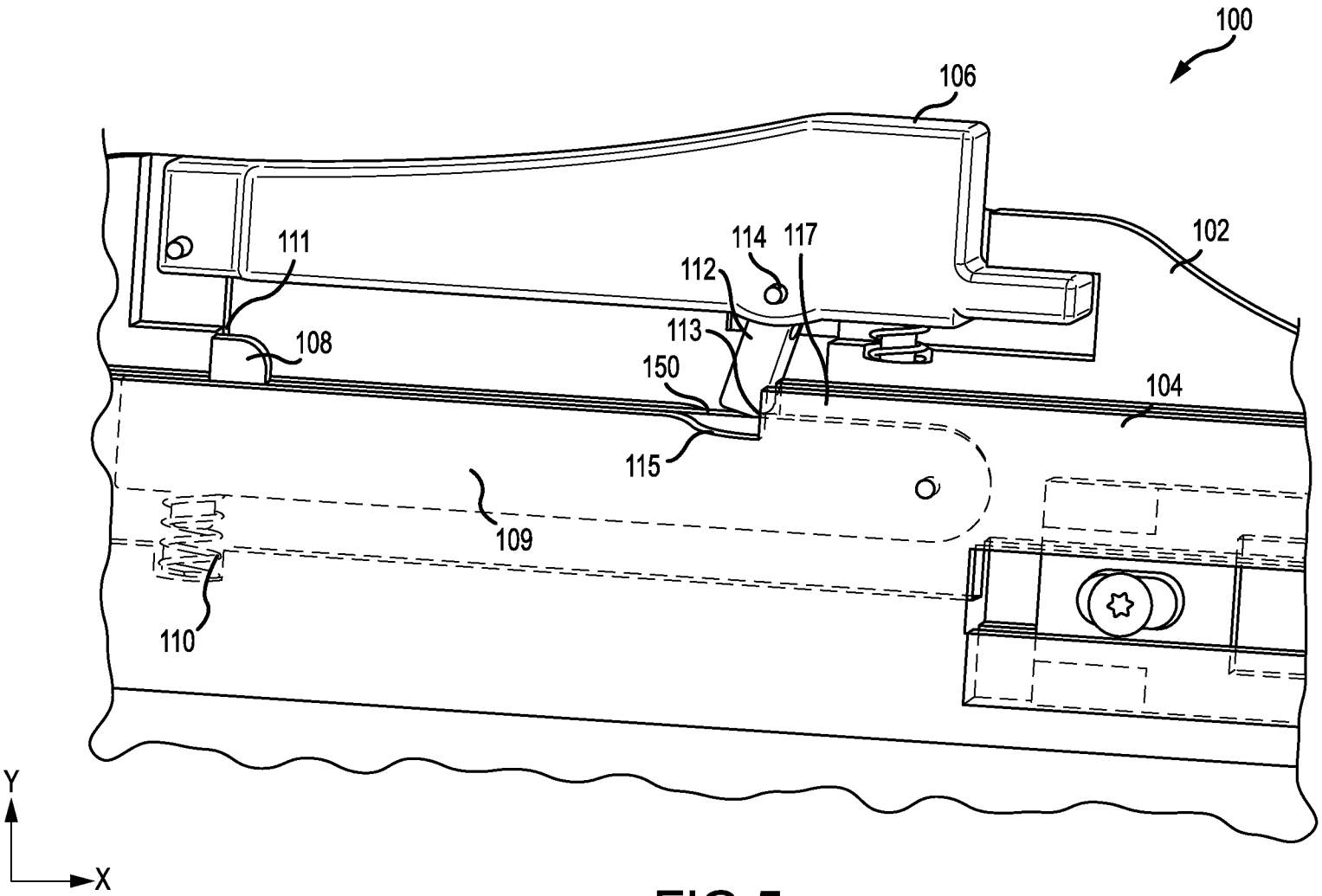
FIG. 5 illustrates a safety mechanism for a safety knife having an undepressed release button and a partially returned sheath, in accordance with various embodiments

Referring now to FIG. 5, safety knife 100 is shown with pawl 112 in a partially extended position, in accordance with various embodiments. Switch 106 is in an undepressed position and sheath 104 is partially extended out of housing 102 in the x direction. Spring 110 urges locking arm 109 to pivot and expose projection 108 from sheath 104 just as projection 108 clears wall 111 in the x direction. Projection 108 contacting wall 111 may prevent sheath 104 from retracting into housing 102 until pawl 112 can engage and depress exposed portion 150 of locking arm 109.

In various embodiments, wall 113 of ridge 117 may prevent pawl 112 from rotating about joint 114 into the fully extended position. Depression of switch 106 in this position may cause pawl 112 to rotate about joint 114 further and/or only partially depress exposed portion 150 of locking arm 109 so that projection 108 cannot clear wall 111. Wall 113 of ridge 117 thus restricts sheath 104 from exposing the blade by disabling the unlocking function of switch 106 until sheath 104 is fully extended and locked into position. Stated another way, ridge 117 allows pawl 112 to rotate into the fully extended position in response to sheath 104 being in a fully extended position.

Figure 6:
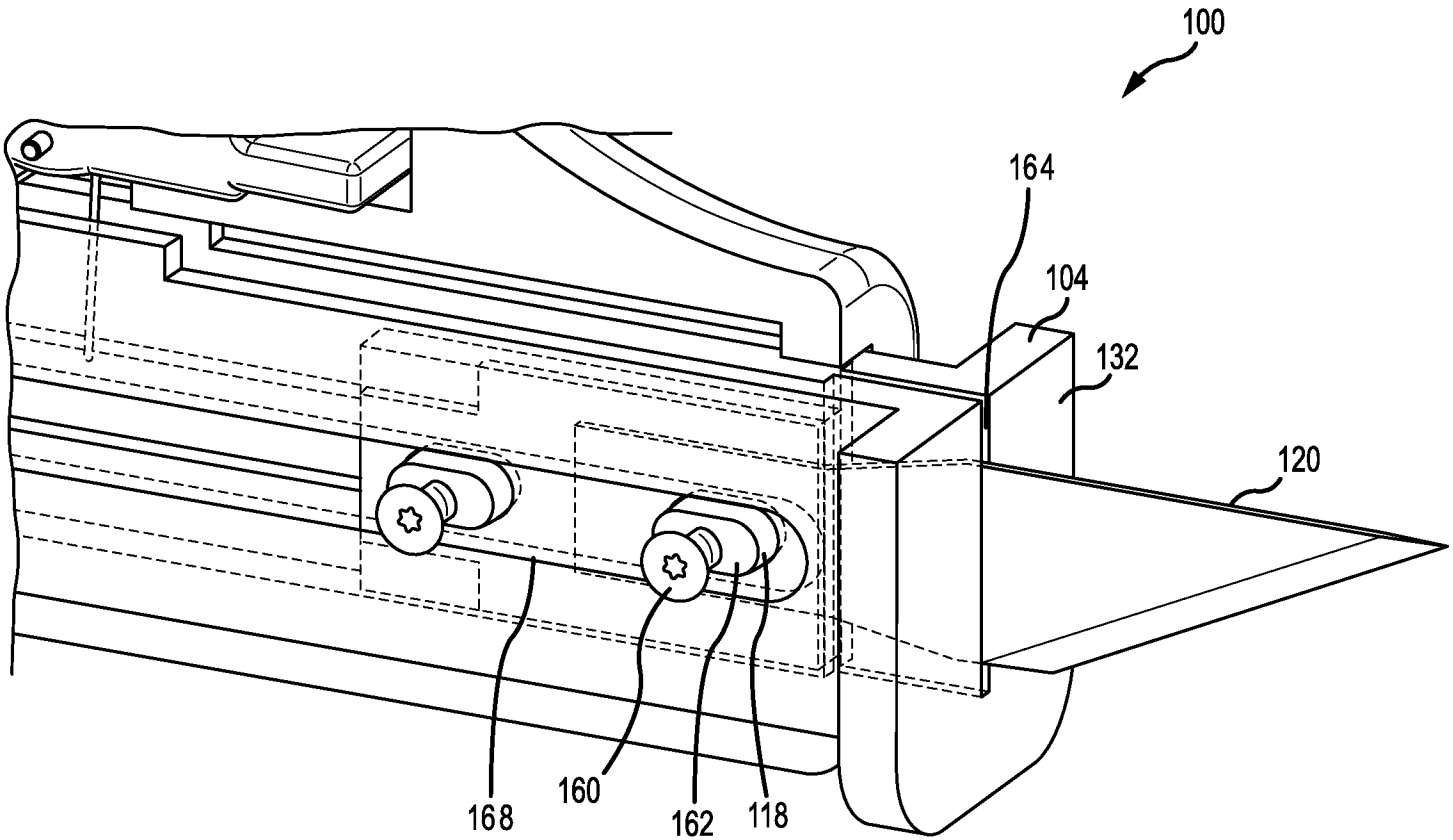
FIG. 6 illustrates a partial cross-sectional view of a blade replacement mechanism, in accordance with various embodiments.
Figure 7:
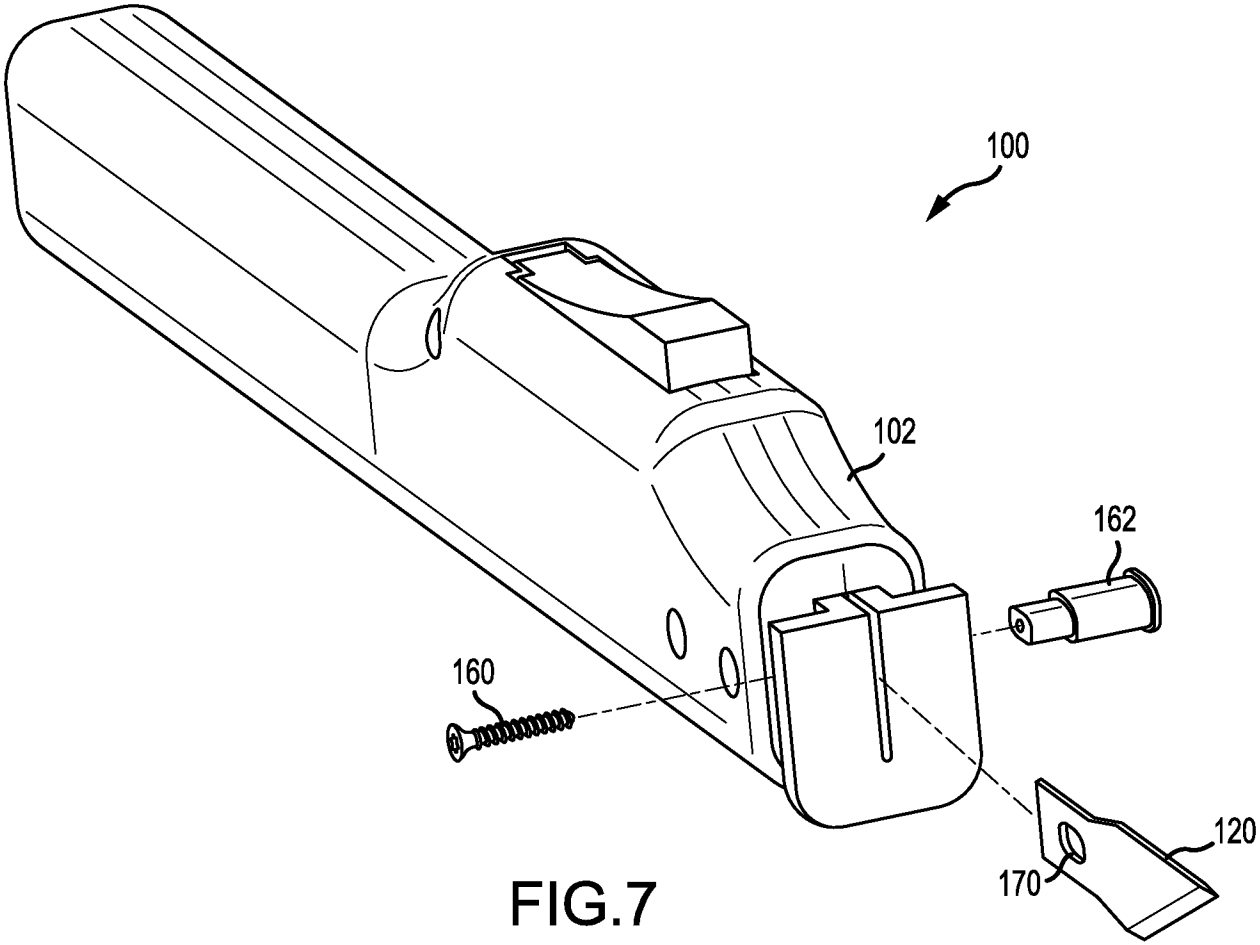
FIG. 7 illustrates a perspective view of a safety knife with an exploded blade retention mechanism, in accordance with various embodiments.

With reference to FIGS. 6 and 7, a blade retention system 118 for safety knife 100 is shown, in accordance with various embodiments. Blade retention system 118 may include a nut 162 having a female opening configured to receive fastener 160. The female opening may be threaded to receive a screw, for example. Nut 162 may have an elongated geometry that aligns with slot 168 in sheath 104 so blade retention system 118 does not impede the translation of sheath 104. Nut 162 may also have a shoulder configured to mate with a ledge of housing 102 and anti-rotate nut 162 within housing 102. Nut 162 may also have a size and shape to engage opening 170 of blade 120 and limit movement of blade 120 relative to housing 102. Blade 120 may be retained within slot 164 defined in surface 132 and extending inward into sheath 104 in a central location on surface 132. Blade retention system 118 may enable quick blade swapping.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosures.

The scope of the disclosures is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiment Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A safety knife, comprising:
a housing defining an internal cavity;
a blade coupled to the housing;
a sheath engaged with the housing and configured to translate into the internal cavity of the housing and expose the blade in response to a force applied to the sheath; and
a locking arm pivotally coupled to the sheath, wherein the locking arm comprises a projection configured to lock the sheath in an extended position by engaging an internal wall of the housing.

2. The safety knife of claim 1, further comprising a switch movably coupled to the housing and a pawl pivotally coupled to the switch, wherein the pawl is configured to depress the locking arm and translate the sheath into the internal cavity of the housing.

3. The safety knife of claim 2, further comprising a recess formed in the sheath to expose and align a portion of the locking arm with the pawl.

4. The safety knife of claim 3, further comprising a torsion spring coupled to the pawl and configured to urge the pawl into a fully extended position.

5. The safety knife of claim 4, wherein the sheath comprises a ridge.

6. The safety knife of claim 1, further comprising a spring coupled to a first anchor point and a second anchor point of the sheath, wherein the spring urges the sheath to cover the blade in response to the force being removed from the sheath.

7. The safety knife of claim 1, further comprising:
a first anchor point coupled to the sheath;
a second anchor point coupled to the housing; and
a spring coupled with and extending between the first anchor point and the second anchor point.

8. The safety knife of claim 1, wherein the coupling between the blade and the housing is a blade retention system.

9. The safety knife of claim 8, wherein the blade retention system comprises:
a nut retained in the housing; and
a fastener extending through an opening in the blade and into the nut.

10. The safety knife of claim 9, wherein the nut comprises an elongated geometry that aligns with a slot formed in the sheath.

11. A safety knife, comprising:
a housing defining an internal cavity;
a blade coupled to the housing;
a sheath slideably engaged with the housing and configured to translate into the internal cavity of the housing to expose the blade;

a switch pivotally coupled to the housing; and a locking arm pivotally coupled to the sheath.

12. The safety knife of claim 11, wherein the locking arm comprises a projection that locks the sheath in an extended position by engaging an internal wall of the housing.

13. The safety knife of claim 11, further comprising a spring coupled to a first anchor point and a second anchor point of the sheath, wherein the spring urges the sheath to cover the blade in response to a force being removed from the sheath.

14. A safety knife, comprising:

a housing comprising a first anchor point and defining an internal cavity;

a blade coupled to the housing;

a sheath slideably engaged with the housing and configured to translate into the internal cavity of the housing to expose the blade, wherein the sheath comprises a second anchor point;

a spring coupled to the first anchor point and the second anchor point; and a locking arm pivotally coupled to the sheath, wherein the locking arm comprises a projection that locks the sheath in an extended position by engaging an internal wall of the housing.

15. The safety knife of claim 14, wherein the spring urges the sheath into a safe state with the blade covered by the sheath in response to a force being removed from the sheath when the blade is lifted from a cutting surface.

16. The safety knife of claim 15, further comprising a switch movably coupled to the housing.

* * * * *